US005673567A

United States Patent [19]

Dubé

[11] Patent Number: 5,673,567

[45] Date of Patent: Oct. 7, 1997

[54] REFRIGERATION SYSTEM WITH HEAT RECLAIM AND METHOD OF OPERATION

[75] Inventor: Serge Dubé, 2595 Bourgogne Street, St. Lazare, Quebec, Canada, J0P 1V0

[73] Assignee: Serge Dubé, Vaudreuil, Canada

[21] Appl. No.: 559,997

[22] Filed: Nov. 17, 1995

[51] Int. Cl.[6] ..... F25B 41/00; F25B 27/00

[52] U.S. Cl. ..... 62/117; 62/196.4; 62/238.6

[58] Field of Search ..... 62/196.4, 238.6, 62/238.7, 117, DIG. 17

[56] References Cited

U.S. PATENT DOCUMENTS

| | | | |
|---|---|---|---|
| 4,286,437 | 9/1981 | Abraham et al. | 62/DIG. 17 |
| 4,437,317 | 3/1984 | Ibrahim | 62/196.4 X |

FOREIGN PATENT DOCUMENTS

| | | | |
|---|---|---|---|
| 8200053 | 1/1982 | WIPO | 62/DIG. 17 |

*Primary Examiner*—William E. Wayner
*Attorney, Agent, or Firm*—Swabey Ogilvy Renault

[57] ABSTRACT

A refrigeration system with heat reclaim and a method of operation to reclaim and put to use substantially all of the heat extracted from the compressor discharge gas. A valve connects the discharge of the compressors to either a remote air-cooled condenser which is located outside a building or to at least one heat reclaim coil located inside the building so that the heat in the hot gas is recovered and used to assist in the heating of a building. The heat reclaim coil could be incorporated in a heat exchanger to heat liquid such as to provide hot water. A pressure control device monitors the pressure in the refrigerant at an outlet of the heat reclaim coil and controls the pressure by directing the refrigerant from the outlet of the reclaim coil through valves whereby to reintroduce the liquid in the system to feed the evaporators or to bypass the refrigerant into the remote air-cooled condenser to drop the pressure thereof prior to reintroducing it into the system.

16 Claims, 3 Drawing Sheets

REFRIGERATION SYSTEM WITH HEAT RECLAIM AND METHOD OF OPERATION

TECHNICAL FIELD

The present invention relates to a refrigeration system with a total heat reclaim and method of operation.

BACKGROUND ART

In a typical refrigeration system, particularly those utilized in merchandising establishments, there is utilized a plurality of evaporators to refrigerate foodstuff of all types. Multiple compressors are associated with this refrigeration equipment and feeds high pressure hot refrigerant gas to remote air-cooled condensers, usually located on the roof of a building, to condense and cool the refrigerant gas to bring it to a reusable state. The cooled refrigerant gas is released back into the cooling system once it has reached a predetermined pressure and condensed. These systems also incorporate a holding tank to maintain sufficient refrigerant for summer and winter operating modes.

Prior art systems also often utilize heat reclaim coils in order to recover approximately up to 40 percent of the heat loss by cooling the hot gas. These heat reclaim coils are usually mounted in an air circulating duct of the establishment and provide extra heat during cold weather periods. The other 60 percent of the heat is released to the outdoors through the remote air-cooled condenser. It is not possible with these prior art systems to reclaim 100 percent of the heat through heat reclaim coils as it would cause the pressure to dip too low during cold weather seasons and the expansion valves of the evaporators would not operate properly and result in system shut-down. Furthermore, it would be necessary to practically double the reservoir of refrigerant and this would cause the condensers and reclaim coils to be flooded with the refrigerant liquid and when the system switches to a warm weather mode there would be too much gas in the system. This would cause the compressors to malfunction and cut out at high pressure.

SUMMARY OF INVENTION

It is therefore a feature of the present invention to provide a refrigeration system with heat reclaim and method of operation which substantially overcomes the above-mentioned disadvantage of the prior art and wherein substantially total heat reclaim is achievable.

Another feature of the present invention is to provide a refrigeration system with a heat reclaim and method of operation which is adaptable to existing refrigeration systems and incorporating a novel pressure control system to regulate the pressure of the refrigerant and hence the temperature at the outlet of a substantially total heat reclaim coil assembly.

Another feature of the present invention is to provide a refrigeration system with a heat reclaim and method of operation and wherein the heat reclaim coil can be sectioned and utilized for various heating purposes and this independent of outdoor climatic conditions.

Another feature of the present invention is to provide a refrigeration system with a heat reclaim and method of operation which can achieve 100 percent heat reclaim with a minimum quantity of refrigerant gas in the system.

Another feature of the present invention is to provide a refrigeration system with substantially total heat reclaim and incorporating a pressure controller to achieve automatic channeling of its refrigerant to obtain pressure regulation by cooling the refrigerant by one or more heat exchange means within the refrigeration system.

According to the above features, from a broad aspect, the present invention provides a refrigeration system with a heat reclaim. The system comprises at least one compressor for compressing hot refrigerant low pressure gas from at least one evaporator to elevate the gas pressure to an operating high pressure level. A remote condenser is connected to the compressor through a directional controlled valve means for cooling the high pressure refrigerant gas to produce a cooled operating liquid refrigerant for feeding the evaporator. At least one heat reclaim coil is connected to the directional controlled valve means for cooling the high pressure gas from the compressor to recover a substantial quantity of heat from the high pressure gas. Pressure control means is provided for monitoring the pressure in the refrigerant at an outlet of the heat reclaim coil and controlling the refrigerant pressure by directing the refrigerant through further valve means to pressure controllable means whereby to produce the cooled operating liquid refrigerant.

According to a further broad aspect of the present invention there is provided a method of reclaiming substantially all of the heat contained in a hot high pressure refrigerant gas in a refrigeration system. The system is provided with at least one compressor and at least one evaporator and a remote air-cooled condenser for cooling high pressure refrigerant gas from the compressor to produce a cooled operating liquid refrigerant for feeding the evaporator. The method comprises the steps of feeding the high pressure refrigerant gas from the compressor to a heat reclaim coil to extract a substantial quantity of heat from the gas while cooling the gas to produce a cooled refrigerant at an outlet thereof. The heat from the heat reclaim coil is directed to a usable means. The pressure of the cooled refrigerant gas is monitored at the outlet of the heat reclaim coil. A control device controls valve means in accordance with the value of the monitored pressure to maintain operating liquid refrigerant in the refrigerant system to feed the evaporators.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
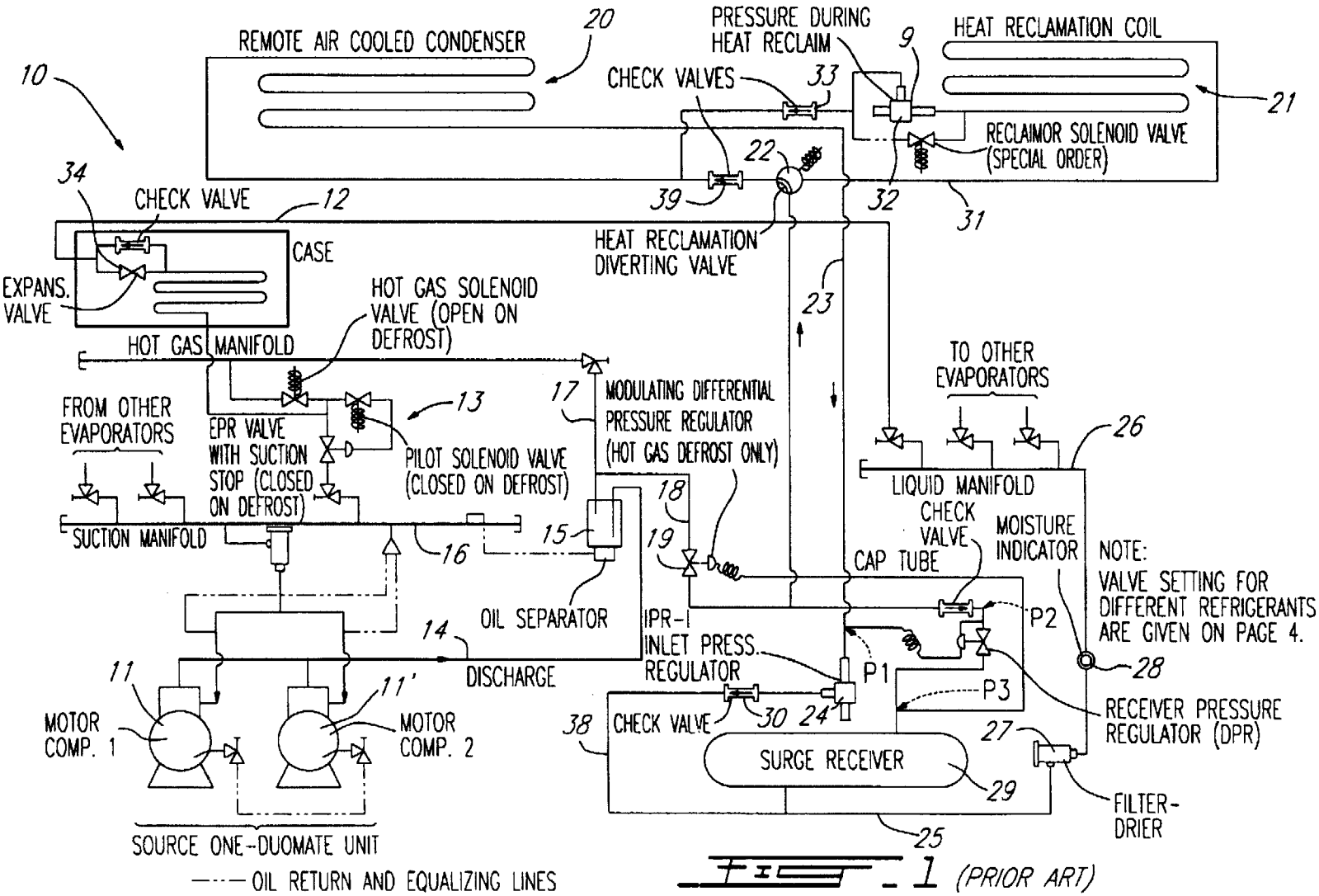
FIG. 1 (PRIOR ART)
FIG. 1 is a schematic view of a prior art refrigeration system utilizing a conventional heat reclaim coil.

Referring to the drawings and more particularly to FIG. 1, there is shown generally at 10 a typical Atmos Duomate refrigeration system with heat reclaim and hot gas defrost. The system utilizes a plurality of compressors 11, 11', and herein up to eight, and whose function is to compress the low pressure refrigerant at the outlet of the evaporators 12, herein a single evaporator 12 being shown. The hot gas from the evaporators 12 is fed through a valve system 13 to the compressors 11 and 11'. The valve system 13 also permits recirculation of the hot gas to defrost the evaporators 12, when required. The high pressure gas at the outlet or on the discharge line 14 of the compressors 11 and 11' is fed to an oil separator 15 where oil is recovered and fed back to the suction manifold line 16. The oil separator has an outlet 17 which uses the hot high pressure gas for the defrost cycle of the evaporators and a further outlet line 18 which feeds the hot gas through a pressure regulator 19 to either a remote air-cooled condenser 20 or a heat reclaim coil 21 via a two-way diverting valve 22. When feeding the condenser 20 the gas passes through a one-way check valve 39. The valve 22 may be operated by suitable thermostat controls.

When the hot gas is directed totally to the remote air-cooled condenser 20, usually located on the roof of a building, the gas is condensed and the outlet of the condenser is fed back into the system through line 23 and 38 once the holding valve 24 senses that the pressure has built up sufficiently whereby the refrigerant is in a usable refrigerating state. The refrigerant is then introduced back into the refrigerant circuit 25 through line 38, to feed the liquid manifold 26 connected to the various evaporators 12. A filter dryer 27 is connected in the refrigerant circuit 25 to remove further moisture from the gas and a moisture indicator 28 is used to monitor the moisture therein. A reservoir 29 is provided in the circuit 25 to retain sufficient refrigerant liquid for the cold winter months of operation of the system where a larger supply is necessary. The check valve 30 prevents the usable refrigerant from returning back into the remote air-cooled condenser 20.

When the system is in the heat reclaim mode, the bi-directional diverting valve 22 is switched to feed the input line 31 of the heat reclaim coil 21. The valve 22 is operated by a thermostat (not shown) which calls for the heat reclaim coil 21 to be supplied for short periods of time to maintain sufficient refrigerant in a usable state. The heat reclaim coil 21 may be mounted in an air moving duct of a heating system, as will be described later, where it is exposed to moving air to extract heat from the coil 21 and at the same time cool the refrigerant gas within the coil. The gas is retained within the coil by a heat reclaim valve 9 which increases the pressure to achieve good heat reclaim within the coil. The hot gas at the outlet of the coil 21 has cooled down somewhat but not sufficiently to be reinjected within the refrigerant circuit 25. Accordingly, the gas is fed back to the remote air-cooled condenser 20 through a check valve 33 where the gas is further condensed by the coil 20 before being introduced back into the refrigerant circuit 25 through the holding valve 24 and the further check valve 30.

It is pointed out that only about 40 percent of the heat in the hot gas in the compressor discharge line 14 can be recovered through the heat reclaim coil as otherwise the system would shut-down. The other approximately 60 percent is released within the atmosphere through the remote air-cooled condenser 20, as previously mentioned. If the heat reclaim coil 21 had been increased in length and fed a longer period of time to try to extract more heat, the system would not function as the refrigerant pressure would drop too low to feed the expansion valves 34 of the evaporators 12, and this is particularly so during cold climatic conditions, such as winter months. Furthermore, it would be necessary to double the gas reserves in the surge receiver tank 29 because the refrigerant at the condenser coils 20 and reclaim coil 21 would be liquefied and flood the coils. Accordingly, when this system switches to its warmer mode or summer mode of operation, the refrigerant gas would exit the heat reclaim coil and the condenser and there would be too much refrigerant in the system which would cause the compressors 11, 11' to malfunction and stall at high pressure.

Figure 2:
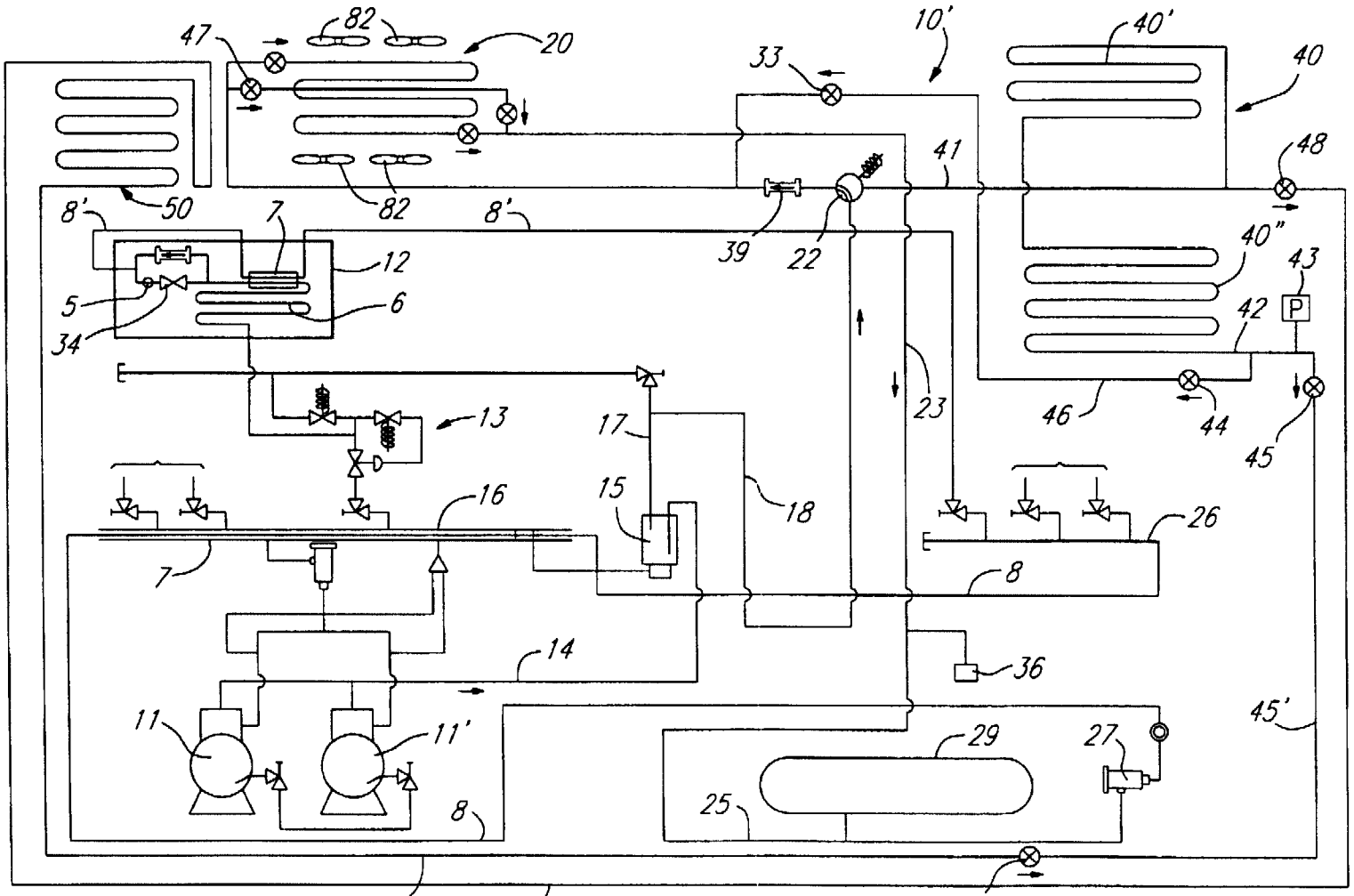
FIG. 2 is a view similar to FIG. 1 but showing the modification of the prior art system to achieve the refrigeration system with a substantially total heat reclaim as provided by the present invention.

Referring now to FIG. 2, there is shown, generally at 10', the modification of the air conditioning/refrigeration system 10 to provide up to total heat reclaim, as is the object of the present invention. As shown in FIG. 2, the heat reclaim coil system 40 may be a single long coil or else may be connected as a plurality of coils, 40', 40", of different lengths whereby to split the heat reclaim into sections and capacities depending on heat distribution requirements at various locations in a building. As hereinshown the heat reclaim coil 40 is segmented in a first serpentine 40' capable of extracting about 40 percent of the heat and a second, serially connected serpentine 40", capable of extracting approximately 60 percent of the heat. When the bi-directional valve 22 is in the heat reclaim position, the high pressure hot gas in the discharge line 14 from the compressors is fed directly into the heat reclaim inlet conduit 41. The hot gas flows through the heat reclaim coils 40' and 40" where heat is extracted by cooling means, such as a fan, and the pressure of the refrigerant at the outlet 42 of the coil is monitored by a pressure sensor 43 which also controls the operation of a first and second uni-directional valve 44 and 45.

If the pressure of the gas at the outlet 42 of the heat reclaim coil assembly 40 is below 175 lbs, the gas has sufficiently condensed whereby to feed the refrigerant back into the refrigerant circuit 25 and accordingly valve 45 is open and valve 44 is closed. Should the pressure at the outlet 42 exceed 220 lbs this signals that the refrigerant gas is still at a high temperature and must be cooled to condense to an operating level. Accordingly, the first uni-directional valve 44 is open and the second valve 45 is closed and the refrigerant gas is then fed through line 46 and through the check valve 33 back into the remote air-cooled condenser 20 whereby to cool the gas down to produce a usable liquid refrigerant. The cooled usable refrigerant is then fed back directly into the circuit 25. The pressure control 36 senses the pressure of the refrigerant and controls the fans of the condenser 20 to produce usable refrigerant for the refrigeration system.

As hereinshown the remote air-cooled condenser 20 is sectioned by a thermostatically controlled valve 47 which is operated when the outside temperature reaches 30° F. or less whereby to reduce the size of the condenser by approximately half. As noted the holding valve 24 of the prior art system no longer is utilized in FIG. 2 and therefore large quantities of liquid gas are not retained at the condenser 20 which is located out of doors. The pressure of the gas within the remote air-cooled condenser 20 drops and the gas liquefies due to the fact that outside air is much cooler than the refrigerant and the condensed refrigerant is fed back into the circuit 25. This in turn causes a pressure drop within the system which is sensed by the pressure sensor 43 which causes the valve 44 to close and valve 45 to open thereby permitting the pressure to increase. When the pressure exceeds 210 lbs a third uni-directional valve 48 opens to prevent the pressure from increasing to above 220 lbs. The valve 48 directs excess gas from the inlet 41 of the heat reclaim coil through line 49 to a further remote air-cooled condenser 50 located outdoors or elsewhere. This condenser has a 10 percent capacity and cools the refrigerant to feed it back into the refrigerant circuit 25 through line 51 and uni-directional valve 52. This valve 48 therefore balances the pressure of the refrigerant at the outlet of the heat reclaim coil 40 once the pressure has obtained an operating pressure of 210 lbs. This valve system provides an efficient operation of the evaporators 12 and permits substantially total heat reclaim from the hot refrigerant gas in the discharge line of the compressors.

A pressure controller (not shown) may be provided to control the operation of the pressure sensors 43 and 36. This pressure controller would contain a computer which is programmed upon receipt of pressure signals from the sensors 43 and 36 to control the valves 44, 45 and 48. The pressure controller would also be connected to an exterior temperature sensor to provide a reference signal. The program within the computer would permit full control of the system. For example, when the outside temperature reaches approximately 50° F., there is little need for heat inside the building and therefore the controller would regulate the valves to lower the pressure at the outlet of the compressors, namely in line 14 and therefore the compressors would consume less electrical energy. The pressure controller is therefore also an energy management system which regulates the system to provide heat internally of the building when required, at substantially no cost as the heat was formally rejected into the outside air and at the same time regulate the operation of the compressors to consume the least possible energy.

It is also obvious that we could dispense of valve 45 and the line 45' which connects back into the refrigerant circuit 25 by simply re-routing the refrigerant at the outlet 42 of the reclaim coil assembly 40 back to the air-cooled condensors 20. By controlling the pressure controller 36 it is possible for the pressure controller to also control the fans 82 associated with the remote air-cooled condensor 20 to further cool the refrigerant gas at the output of the reclaim coil assembly until it is in a usable state. Of course, the condensor 20 may be sectioned off in many more sections than that shown in FIG. 2 and by sensing the pressure of the gas the pressure controller would automatically kick-in the fans until the gas has sufficiently cooled to produce a desired operating refrigerant. The refrigerant is returned to the refrigerant circuit 25 through the line 23.

In order to obtain maximum efficiency in cooling the refrigerant prior to introducing it within the evaporators 12, the feedline 8 from the outlet of the filter dryer 27 is passed through the suction pipe 7 of the suction manifold line 16 whereby to effectuate a heat exchange to cool the liquid line. Also, the line at 8' is fed through a heat exchanger jacket 7 provided about a section of the evaporator coil 6 which is provided in a refrigerator to again cool the gas before it is introduced into the evaporator 12. A filter strainer 5 is provided at the inlet to remove any scale within the refrigerant gas or liquid contained within the line 8'. It is noted that substantially all of the gas within that line is liquefied at this stage of the circuit. It can therefore be seen that maximum cooling efficiency is achieved to assist with the proper operation of the system to achieve total or substantially 100 percent heat reclaim, when necessary and this may be done automatically by the pressure controller 80.

Figure 3:
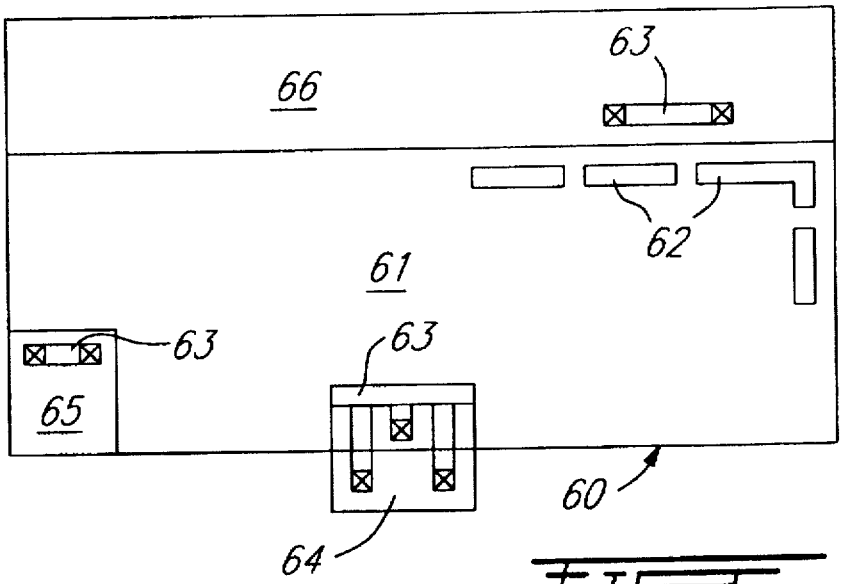
FIG. 3 is a schematic view showing the heat reclaim coil sectioned for use in heating ducts to heat various areas of a building.

Referring to FIG. 3, there is shown a schematic of a typical floor plan 60 of a merchandising building wherein a large space 61 is provided to display foodstuff and other materials and in which a plurality of refrigerated display counters 62 are installed and in each of which is mounted the evaporators 12. The heat reclaim coils 40 are sectioned and mounted in ducts such as duct 63 to provide heat to various locations of the building, herein a building entrance 64, a car order pick-up enclosure 65 where outside air is continuously admitted and a back store area 66 in which inventory is maintained. Accordingly, by utilizing the system of the present invention substantially 100 percent of the heat loss from the refrigeration system is recovered and re-used in cold weather months and this results in an economy to the operation of the building as it reduces the cost of heating the building by cutting the consumption of electrical energy or heating fuels. Although the heat reclaim coil has been shown as being sectioned, it is also obvious that it could be a single serpentine coil of sufficient length and capable of extracting substantially 100 percent of the heat from the hot gas.

Figure 4:
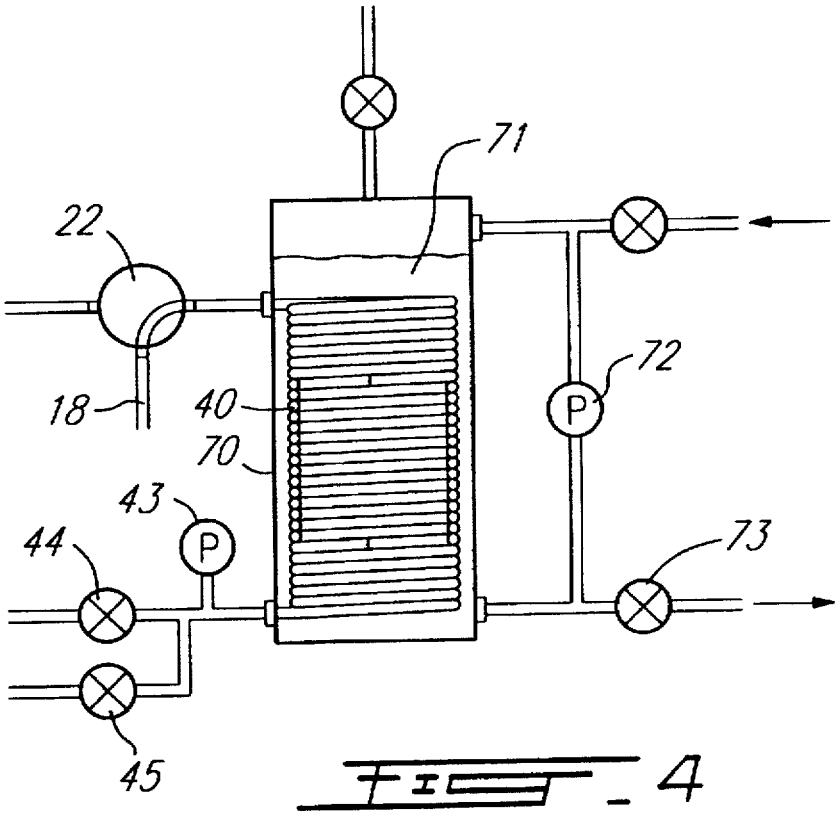
FIG. 4 is a schematic view showing the heat reclaim coil utilized in a heat exchanger for heating water.

FIG. 4 illustrates another application of the heat reclaim coil wherein the coil 40 is located within a water reservoir 70 and exposed to water 71 which is circulated therein by a pump 72 whereby to feed a hot water supply system 73. As hereinshown the pressure control device 43 is connected to the outlet conduit 42 of the heat reclaim coil 40 and the bi-directional diverting valve 22 is connected to the inlet. The heat reclaim coil 40 at the interior of the housing 70 may have any suitable configuration and water may be fed in contact with this coil by encapsulating the coil in a further circumferential pipe with water flowing between the coil and the inner side wall of the pipe, not shown, but obvious to a person skilled in the art, instead of exposing the coil in a large reservoir.

When comparing the prior art refrigeration system of FIG. 1 with the modified system of FIG. 2 it can be seen that a novel control system has been proposed which is substantially different from the prior art. There is no longer a need for the holding valves and various other pressure control valves as with the prior art of FIG. 1. Also the need to provide a large reserve of refrigerant for operating the system in the cold winter mode is eliminated.

The pressure controller with microprocessor also gives the refrigeration system of the present invention increased flexibility by controlling the pressure in the system. By increasing the pressure during cold exterior temperatures the compressors consume less energy as some can be cut-out while achieving efficient refrigerant and total heat reclaim. Also, we provide more efficient use of the remote air-cooled condensor(s) and more efficient sub-cooling of the refrigerant by heat exchange within the system component parts.

It is within the ambit of the present invention to cover any obvious modifications of the preferred embodiment described herein, provided such modifications fall within the scope of the appended claims.

I claim:

1. A refrigeration system with a heat reclaim, said system comprising at least one compressor for compressing hot refrigerant low pressure gas from at least one evaporator to elevate said gas pressure to an operating high pressure level, a remote condenser connected to said compressors through a directional controlled valve means for cooling said high pressure refrigerant gas to produce a cooled operating liquid refrigerant for feeding said evaporator, at least one heat reclaim coil connected to said directional controlled valve means for cooling said high pressure gas from said compressor to recover a substantial portion of the heat from said high pressure gas, and pressure controller device connected to an outlet of said heat reclaim coil to sense the pressure of said refrigerant gas at said outlet and for controlling said refrigerant pressure by directing said refrigerant through further valve means to pressure controllable means whereby to produce said cooled operating liquid refrigerant, said further valve means having a first uni-directional valve connecting said outlet of said heat reclaim coil to said remote condenser to further cool said refrigerant gas from said outlet, and a second uni-directional valve connecting said outlet of said heat reclaim coil to an operating refrigerant circuit feeding said evaporator, said first and second uni-directional valves bring controlled by said pressure controller device and wherein said first uni-directional valve when in an "open" condition said second uni-directional valve being in a "closed" condition, and vice-versa.

2. A refrigeration and heat reclaim system as claimed in claim 1 wherein said further valve means further comprises a third uni-directional valve connected to an inlet of said heat reclaim coil and to a further remote condenser to bypass a portion of said high pressure refrigerant gas being fed to said heat reclaim coil by said compressor whereby to further cool a portion of said refrigerant gas by said remote condenser when said pressure at said outlet exceeds a predetermined operating value.

3. A refrigeration and heat reclaim system as claimed in claim 2 wherein said heat reclaim coil is comprised of at least two coils connected to one another and located spaced apart to recover heat for use at different locations.

4. A refrigeration and heat reclaim system as claimed in claim 3 wherein there are a plurality of heat reclaim coils connected in series with one another and forming heat generators to provide heat to various locations in a building incorporating said refrigeration system.

5. A refrigeration and heat reclaim system as claimed in claim 2 wherein said refrigeration system has a plurality of said compressor and evaporator, said remote condenser being an air-cooled condenser located outdoors of a building in which said refrigeration system is incorporated.

6. A refrigeration and heat reclaim system as claimed in claim 2 wherein said remote condenser is an air-cooled condenser located outdoors, said condenser being segmented by thermostatically controlled valves whereby only segments of said condenser are used to condense gas when outside temperatures drop below a predetermined cold temperature value.

7. A refrigeration and heat reclaim system as claimed in claim 2 wherein said pressure controller device actuates said first uni-directional valve to open when said pressure of said refrigerant gas reaches a high predetermined value, said second valve being actuated to open when said first valve is closed, said third uni-directional valve being a balancing valve to maintain said refrigerant gas pressure at said outlet of said heat reclaim coil within operating limits and below said high predetermined value.

8. A refrigeration and heat reclaim system as claimed in claim 7 wherein said high predetermined value is 220 lbs pressure, said third valve being actuated to open by said controller device when said pressure at said outlet reaches 210 lbs pressure.

9. A refrigeration and heat reclaim system as claimed in claim 1 wherein said directional controlled valve means is a bi-directional valve which is thermostatically controlled.

10. A refrigeration and heat reclaim system as claimed in claim 1 wherein said pressure controller device has a microprocessor to automatically control said further valve means to cycle said refrigerant at said outlet of said heat reclaim coil to said pressure controllable means when said refrigerant is above a predetermined pressure level stored in said microprocessor.

11. A refrigeration and heat reclaim system as claimed in claim 10 wherein said pressure controllable means is constituted by at least a portion of said remote condensor.

12. A refrigeration and heat reclaim system as claimed in claim 11 wherein said remote condensor is comprised of a plurality of independent coils and control valves, each coil having one or more cooling fans, said control valves and cooling fans being controlled by said pressure controller device to lower the pressure of said refrigerant to a predetermined pressure level stored in said microprocessor, a pressure sensor connected to an outlet line of said remote condensor to feed pressure signals to said microprocessor, said microprocessor operating said further valve means.

13. A method of reclaiming substantially all of the heat contained in a hot high pressure refrigerant gas in a refrigeration system, wherein said system is provided with at least one compressor and at least one evaporator and a remote air-cooled condenser for cooling high pressure refrigerant gas from said compressor to produce a cooled operating liquid refrigerant for feeding said evaporator, said method comprising the steps of:

i) feeding said high pressure refrigerant gas from said compressor to a heat reclaim coil to extract said heat from said gas while cooling said gas to produce a cooled substantially condensed refrigerant at an outlet thereof, ii) directing said heat to a heat usable means, iii) monitoring the pressure of said refrigerant at said outlet of said heat reclaim coil, iv) controlling valve means in accordance with the value of said monitored pressure to produce operating liquid refrigerant to feed said evaporators, said valve means comprising a first uni-directional valve between an outlet of said heat reclaim coil and said condenser and a second uni-directional valve between said outlet of said heat reclaim coil and said cooled operating liquid refrigerant, and v) actuating said first valve to open and said second valve to close when said refrigerant gas at said outlet reaches a predetermined high pressure value.

14. A method as claimed in claim 13 wherein said step (iv) further comprises providing a third uni-directional valve between an inlet of said heat reclaim coil and a further remote condenser, and bypassing a portion of said refrigerant gas being fed to said heat reclaim coil to further cool said refrigerant gas when said outlet pressure exceeds a predetermined value to balance said pressure at said outlet when in a cooled operating liquid refrigerant range.

15. A method as claimed in claim 13 wherein said step (ii) comprises extracting heat from said heat reclaim coil by passing an air current therethrough to produce a stream of hot air to heat a space.

16. A method as claimed in claim 13 wherein said step (ii) comprises extracting heat from said heat reclaim coil by passing water in contact with said coil to produce a heat exchange device to produce hot water.

* * * * *